US006278660B1

(12) United States Patent
Tognazzini

(10) Patent No.: US 6,278,660 B1
(45) Date of Patent: Aug. 21, 2001

(54) TIME-ZONE-TRACKING TIMEPIECE

(75) Inventor: Bruce Tognazzini, Woodside, CA (US)

(73) Assignee: Sun Microsystems, Inc., Mountainview, CA (US)

( * ) Notice: Subject to any disclaimer, the term of this patent is extended or adjusted under 35 U.S.C. 154(b) by 0 days.

(21) Appl. No.: 08/639,815

(22) Filed: Apr. 29, 1996

(51) Int. Cl.[7] ..... G04B 5/22
(52) U.S. Cl. ..... 368/21; 368/47
(58) Field of Search ..... 368/20–30, 47

(56) References Cited

U.S. PATENT DOCUMENTS 4,501,502 * 2/1985 Van Orsel ..... 368/47
5,077,706 * 12/1991 Ganter ..... 368/47
5,089,814 * 2/1992 DeLuca et al. ..... 368/21
5,375,018 * 12/1994 Klausner ..... 368/47
5,408,444 * 4/1995 Kita et al. ..... 368/47
5,422,863 * 6/1995 Minowa et al. ..... 368/47
5,455,807 * 10/1995 Nepple et al. ..... 368/47
5,510,797 * 4/1996 Abraham et al. ..... 368/47
5,625,556 * 4/1997 Janky et al. ..... 368/47

OTHER PUBLICATIONS

Webster's Ninth New Collegiate Dictionary 1044 (1990).

* cited by examiner

*Primary Examiner*—Bernard Roskoski
(74) *Attorney, Agent, or Firm*—McDermott, Will & Emery

(57) ABSTRACT

Techniques are disclosed for automatically updating timepieces as time zone boundaries are crossed. Time zone boundaries are identified on mapping software and combined with location information from a GPS receiver to determine when a time zone boundary is crossed. In another approach, information about current time transmitted to a timepiece for update from transmitter(s) located at one or more locations frequented by travellers, such as airports, railroad and bus terminals, ports of call and hotels.

7 Claims, 13 Drawing Sheets

UPDATE FORMAT

TIME-ZONE-TRACKING TIMEPIECE

BACKGROUND OF THE INVENTION

1. Field of the Invention

The invention relates to time keeping and more particularly to a timepiece which automatically adjusts time as time zone boundaries are crossed.

2. Description of Related Art

People who travel frequently find it necessary to frequently adjust their watches to reflect the correct time for the time zone in which their destination is located. Multiple time zone watches are known which attempt to deal with this problem by simultaneously displaying the correct time for a plurality of time zones. This has the disadvantage that the multiple time zone displays must be independently set in advance. It is possible to set them incorrectly with undesirable results such as missed flights and appointments.

The global positioning system (GPS) is a constellation of twenty-four satellites that orbit the earth twice a day, transmitting precise time and positioning information to anywhere on the globe, twenty-four hours a day. The system was designed and deployed by the U.S. Department of Defense to provide continuous, worldwide position and a navigation data for the use of the United States and allied military forces. The potential for commercial applications of GPS were recognized early in the system's development and a determination made to allow free access to GPS signals with certain constraints applied.

Each GPS satellite broadcast two signals, PPS (Precise Positioning Service) and SPS (Standard Positioning Service). The PPS signal is an encrypted military-access code. The SPS is an unencrypted, spread-spectrum signal broadcast at 1,575.42 MHz. Unlike signals from Land-base navigation systems, the SPS signal is virtually resistant to multi-path and nighttime interference, it is unaffected by weather and electrical noise.

GPS receivers listen to signals from either three or four satellites at a time and triangulate a position fix using the interval between the transmission and reception of the satellite signal. Any particular receiver tracks more satellites than are actually needed for a position fix. The reason for this is that if one satellite becomes unavailable, the receiver knows exactly where to find the best possible replacement. Three satellites are required for two-dimension positioning (i.e. position only). Four satellites are required for three-dimension positioning (i.e. position and elevation). In general, an SPS receiver can provide position information with an error of less than twenty-five meters and velocity information with an error of less than five meters per second. A PPS receiver permits much greater accuracy. The higher accuracy is obtainable with the GPS make it suitable as a precision survey instrument.

THE PROBLEMS

When traveling long distances, timepieces need to be reset when leaving one time zone and entering another. This problem is particularly noticeable aboard common carriers such as trains, buses, ships and airliners which simply do not display public clocks, presumably because of the maintenance required to reset the clocks as the boundaries of time zones are traversed.

Another problem that exists is a need to provide timepieces with the correct time to begin with. Ideally, this would be done automatically. Another problem which exists is the handling of unofficial "time zones" such as some ski resorts, which maintain daylight savings time even in the middle of winter.

Another problem which exists is a need to reduce costs for any implementation of a time zone correcting timepiece.

SUMMARY OF THE INVENTION

The present invention overcomes the problems of the prior art by providing apparatus, processes, systems and computer program products which implement time-zone-tracking for timepieces.

In one form, the time zone tracking timepiece combines a timekeeper, such as a digital clock or watch, with a digital map and a GPS receiver. The GPS receiver tracks the users changing longitude and latitude and compares it with the internal time zone map. When the timepiece crosses a time zone boundary, the presented time is automatically updated.

In a lower cost solution, the invention would utilize, an electromagnetic or infrared link between a GPS linked clock with mapping information, such as might be mounted in a vehicle, and one or more individual timepieces, such as wristwatches which are updated from the GPS equipped station.

In another implementation, fixed locations frequented by long distance travellers, such as airports, hotels, harbors, bus terminals and other such locations can be equipped with the ability to transmit correct time, location and other information to individual timepieces for display. Manual override of the automatic update, could, of course, be included.

The invention is directed to a timepiece which automatically changes time as the timepiece crosses a time zone boundary. The timepiece includes a memory medium storing information about time zone boundaries, a global positioning satellite system, a clock, and a computer configured to change the time of the clock when location information from the global position satellite system indicates a time zone boundary has been crossed.

The invention is also directed to a timepiece which can be remotely updated, a clock and a receiver configured to receive externally supplied update information over a communications link for updating said clock. A transmitter for providing update information can be located on a vehicle or operated from a fixed position. The communications link can be an electromagnetic communications link such as infrared or radio. The update information may simultaneously update the name of the city in which the timepiece is located as a way to verify that the time showing is the time for the city one is currently in rather than a city one previously visited.

The invention is also directed to a system for updating time information, including (1) an update transmitter which has a memory medium storing information about time zone boundaries, a global positioning satellite system providing location information, a system clock, and a computer connected to the memory medium, the global positioning satellite system and the system clock, configured to change the time of the system clock when said location information indicates a time zone boundary has been crossed, and a communications transmitter for sending update information to a remote receiver; and (2) a timepiece, including a timepiece clock, and a communications receiver configured to receive update information for updating the timepiece clock. The computer is configured to periodically connect to a time standard and to calibrate the system clock with time standard information.

The invention is also directed to a method of updating a timepiece to reflect the correct time as a time zone boundary is crossed, including using a navigation system to determine location of the timepiece, and updating the timepiece to reflect the correct time when the navigation system indicates a time zone boundary has been crossed.

The invention is also directed to a method of updating a timepiece to reflect the correct time as a time zone boundary is crossed, including transmitting update information to the timepiece, and receiving the update information at the timepiece and updating the timepiece to reflect current time and location (e.g. the name of the city in which the timepiece is located).

The invention is also directed to a computer program product for implementing time correction for a timepiece including a computer readable memory medium and a computer program, the computer program including steps of comparing information about a current location of a timepiece in relation to a time zone boundary, and updating a clock with a time value appropriate for the time zone of the current location.

The invention is also directed to a computer program product for implementing time correction including a computer readable memory medium and a computer program, the computer program including a routine for receiving at least a time value from a remote source and updating a timepiece with said time value.

The invention is also directed to a computer program product for implementing time correction including a computer readable memory medium and a computer program including a routine for periodically sending at least a time value to a remote timepiece and updating said timepiece with said time value.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all of that departing from the invention. Accordingly, the drawing and description are to be regarded as illustrative in nature and not as restrictive.

BRIEF DESCRIPTION OF DRAWINGS

The objects, features and advantages of the system of the present invention will be apparent from the following description in which.

NOTATIONS AND NOMENCLATURES

The detailed descriptions which follow may be presented in terms of program procedures executed on a computer or network of computers. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

DESCRIPTION OF THE PREFERRED EMBODIMENT

Figure 1:
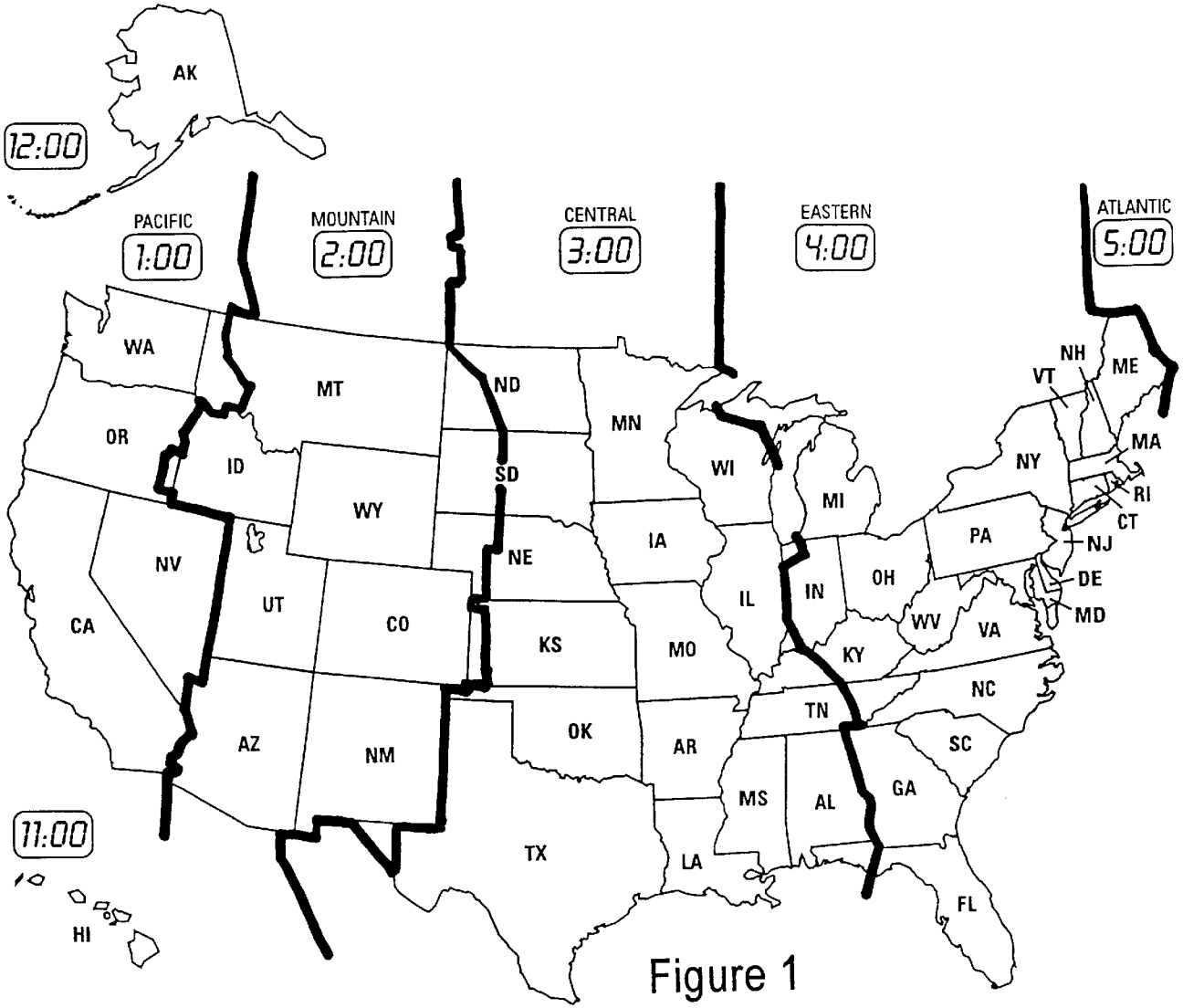
FIG. 1 is an illustration of a map of a portion of the world showing exemplary time zone boundaries.

FIG. 1 is an illustration of a map of a portion of the world showing exemplary time zone boundaries. A traveller going from Washington D.C. to San Francisco might go through a hub at Dallas-Fort Worth and need to change planes. With a watch set on Washington D.C. time, and even with a secondary display for San Francisco time, a traveller might be uncertain as to which time zone he was in or, if he had slept, whether he was routed through Dallas-Fort Worth or Chicago on the way to San Francisco. A failure to assess current time in Dallas-Fort Worth, could result in a missed plane connection and other unpleasant consequences.

Figure 2:
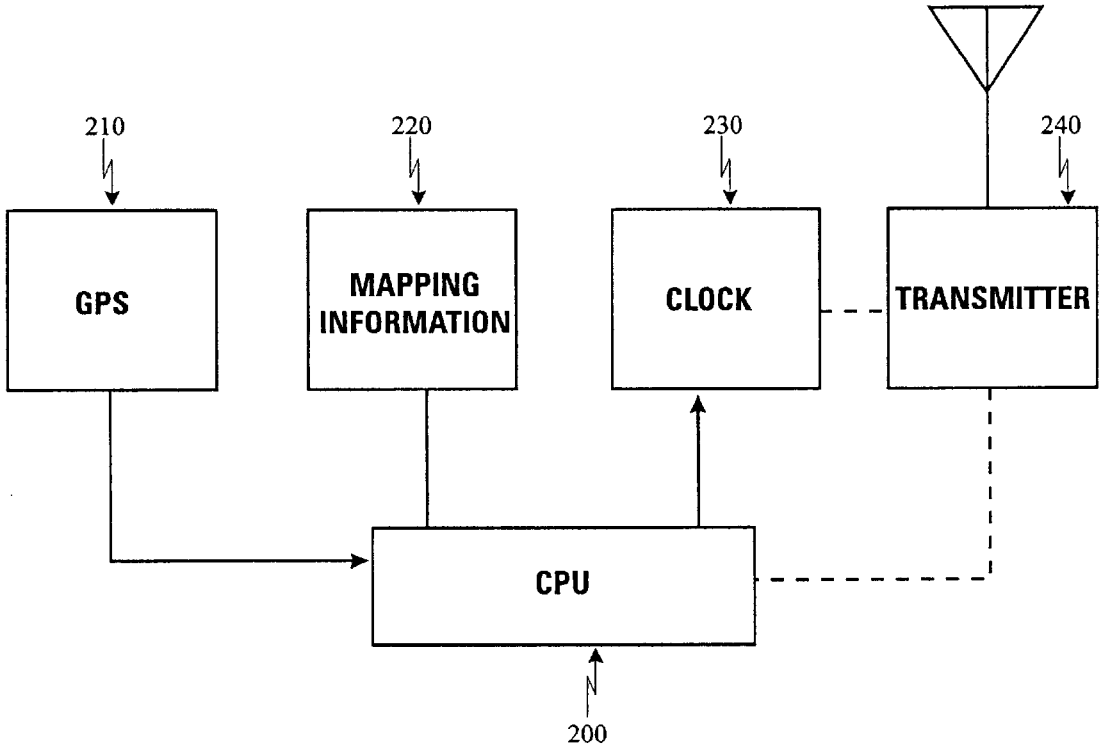
FIG. 2 is a block diagram of a time zone correcting timepiece in accordance with the invention.

FIG. 2 is a block diagram of a time zone correcting timepiece in accordance with the invention. CPU 200 is connected to a GPS receiver 210 and clock 230. CPU 200 runs mapping software 220 as indicated by the connection between block 220 and CPU 200. An optional transmitter 240 can receive time information from clock 230 and location information from CPU 200 for transmission to remote timepieces for updating their time and location to coincide with that determined by apparatus shown in FIG. 2. In operation, the GPS receiver 210 provides precise positioning information to CPU 200 which then links to mapping information to determine the city and time zone that are appropriate for the location indicated by the GPS receiver. Additionally, information received by the GPS receiver can be utilized to service a time standard for calibrating clock 230, subject to time zone offsets. From location information provided by GPS receiver 210 and from mapping information available to it, CPU 200 can determine the city or other political subdivision in which the timepiece is located. This information can be provided to the clock for display locally and to transmitter 240 for transmission to remote timepieces for updating them with current information.

Figure 3:
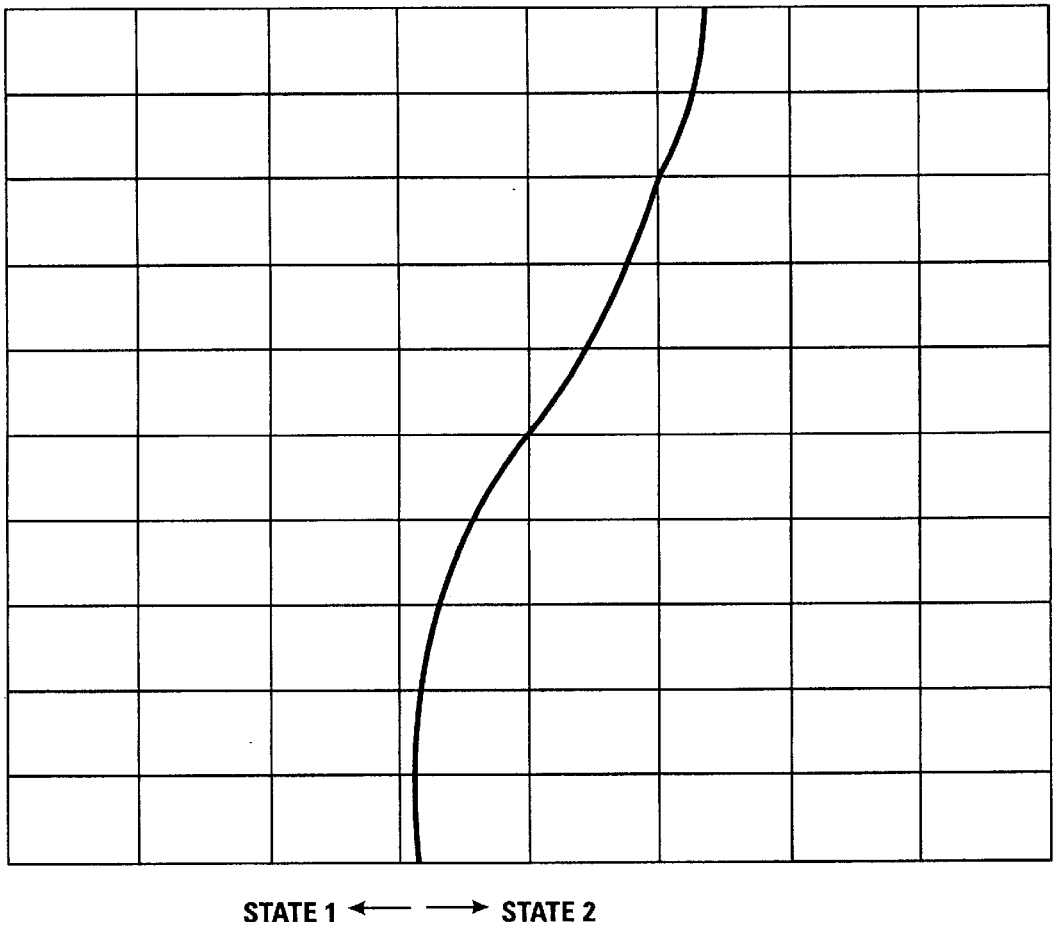
FIG. 3 is an illustration of a subdivision of a map into grids and a boundary of a political subdivision running through various grids on the map.

FIG. 3 is an illustration of a subdivision a map into grids and illustrates a boundary of a political subdivision running through various grids on the map. Mapping software is well known in the art and is widely available commercially. In one form of mapping software, a map is divided into grids as shown in FIG. 3. A database is associated with the map and items of significance to be shown on the map are contained within a portion of the database associated with the grid. A database of mapping information is typically maintained on a CD ROM or other optical storage type medium. The items within each grid of interest could, for example, include the name of each street within the grid, the range of addresses for each street, the length of the street within the grid, the names of intersecting streets and whether they are controlled by a stoplight or stop sign, points of interest and a geometric definition of the shape of a portion of an object, such as a street, lying within the grid. Note that such information is typically maintained for the smallest subdivisions or grids of a map. It is possible to adjust the resolution of a display using mapping software type information by aggregating low level grids into larger grids and reducing the amount of detail presented at the lower resolution views. As one can see, a time zone boundary can be handled in the same way as a street or boundary of a political subdivision.

It may be desirable from a cost or efficiency perspective to keep a representation of a time zone boundary very simple and to utilize an inexpensive GPS receiver.

Figure 4:
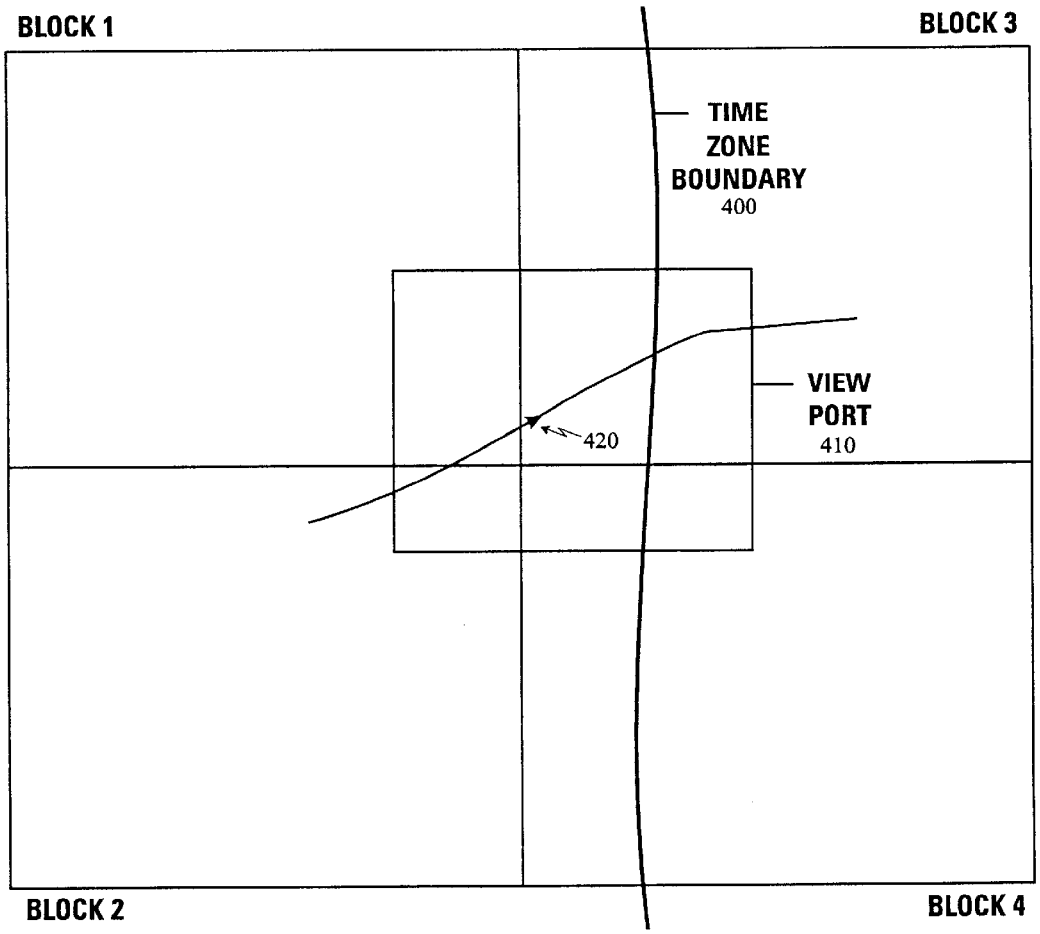
FIG. 4 is an illustration of viewport displayed by exemplary navigation software showing current location on a map vis a vis a time zone boundary.

FIG. 4 is an illustration of a viewport displayed by exemplary navigation software showing current location on a map vis-a-vis a time zone boundary 400. Viewport 410 represents the portion of mapping information actually displayed to a user. Current location of the user is indicated by caret 420 which points in the direction of motion of the user. Typically, the viewport is rotated based on the direction of travel so that features ahead of the current location are displayed at the top of the viewing screen. Blocks 1–4 represent map grids which can be laid out in, for example, a bit mapped display of information in the vicinity of the current location of the user and the viewport can be moved to scroll information from the bit map into the viewing screen as the user's location changes. Blocks can be readjusted periodically as needed to insure that a smooth transition will occur as the user moves from block to block (from grid to grid). As a user at caret location 420 moves toward the time zone boundary, it will become apparent that the time should change and the point at which the user crosses the time zone boundary can be determined in the same manner that is utilized to determine when a user crosses an intersecting street or political boundary.

Figure 5:
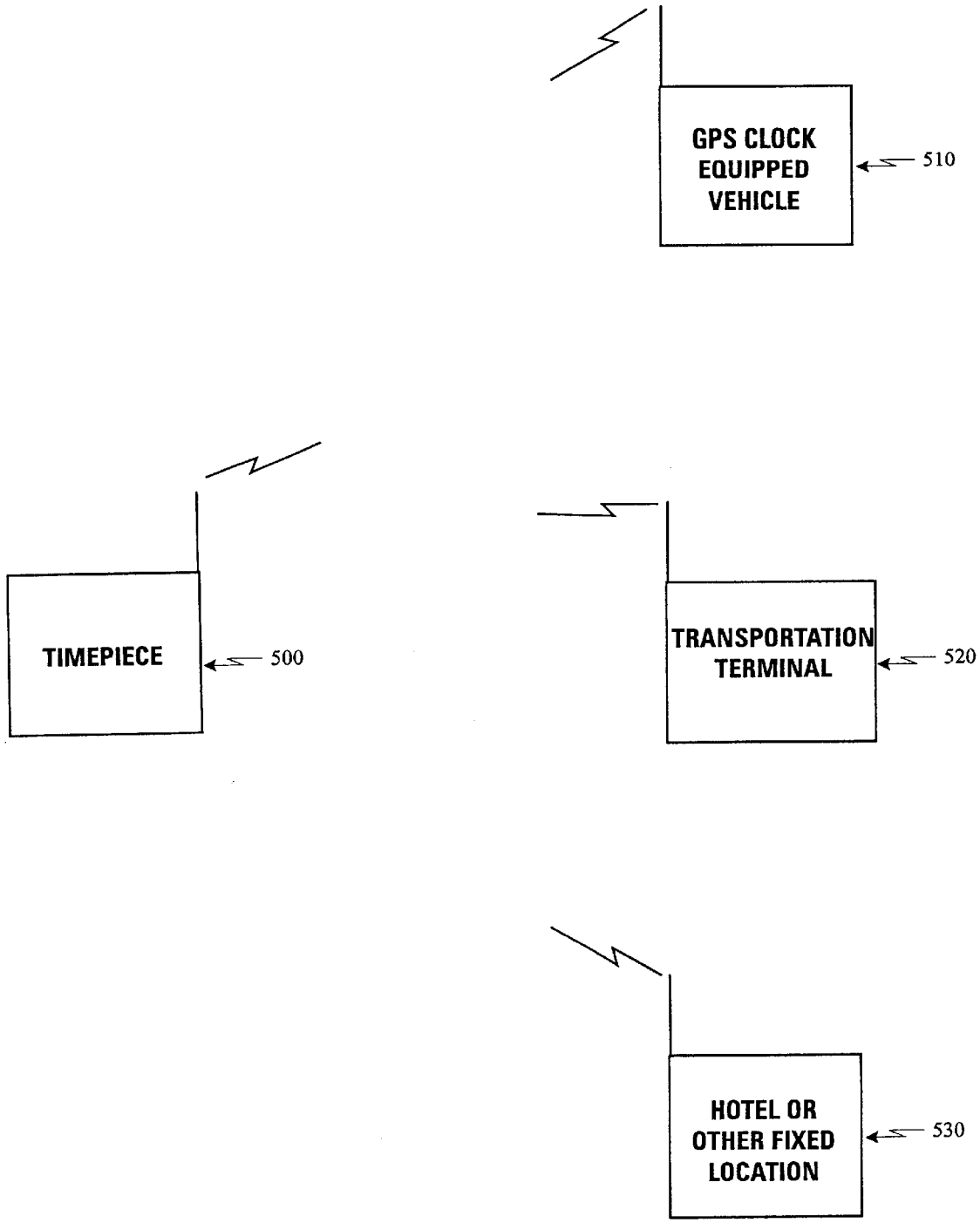
FIG. 5 is a illustration showing how a timepiece without GPS capability can be updated to reflect time in a current time zone.

FIG. 5 is an illustration showing how a timepiece without GPS capability can be updated to reflect time in a current time zone. FIG. 5 shows timepiece 500 which can be updated by information transmitted from a GPS clock equipped vehicle 510, from a transportation terminal 520 or from a hotel or other fixed location 530. Preferably, information is transmitted to the timepiece using electromagnetic radiation, such as infrared or a radio link. A radio link is preferred because communications can be received even when a timepiece, such as a watch, is obscured by some object such as a sleeve of a jacket. Updating from a GPS equipped vehicle 510 is preferred when a person is travelling in the vehicle. When using common carrier transportation, and the common carrier is not equipped with GPS equipped clocks capable of updating timepieces remotely, one may desire to position an update transmitter either at transportation terminals where trips might begin and end and/or at hotels or other fixed locations frequented by travelers. Thus, a traveller arriving at a destination in a new time zone would likely be updated by passing in proximity to an update transmitter. Typically update transmitters might be located at harbors, airports, bus stations, train stations, hotels or the like. GPS equipped clocks might be located in motor vehicles, boats, ships, trains, aircraft, busses, tractor trailers and the like.

Figure 6:
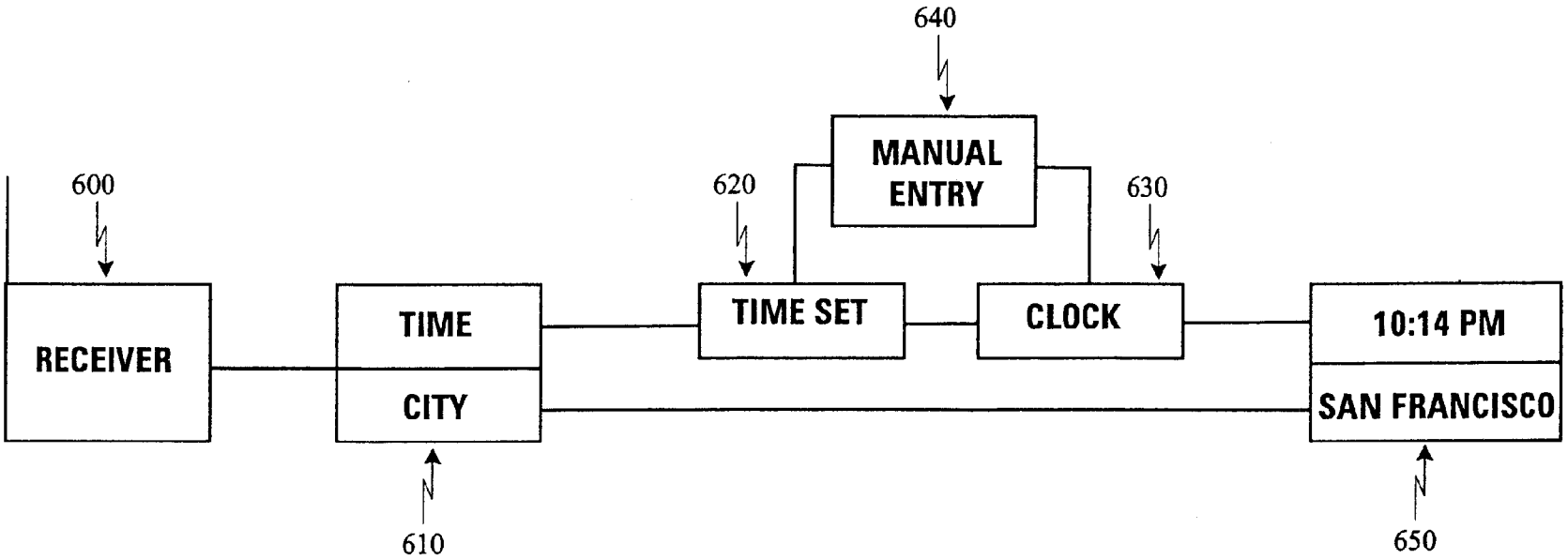
FIG. 6 illustrates a functional representation of how a timepiece can be updated to reflect current time in a time zone and to reflect the identity of a city in which the timepiece is located.

FIG. 6 is a functional illustration of how a timepiece can be updated to reflect current time in a time zone and current city. A receiver 600 receives a signal from a nearby transmitter, such as shown in FIG. 5 at items 510, 520 and 530. The receiver decodes the information sent from the transmitter and stores the information in memory 610 which is shown as having two parts, one for time and one for city. If the received time differs from the time maintained in clock 630, the time will be set to the received time as depicted by block 620. The output of the clock 630 is displayed in one portion of display 650. If for some reason, manual override of the automatically set time is desired, a manual entry of time may be made as depicted at 640. Memory 610 also includes a portion for storing information about the city in which the timepiece is located. When that information is received, it is transmitted directly to the corresponding part of the timepiece display 650.

Figure 7:
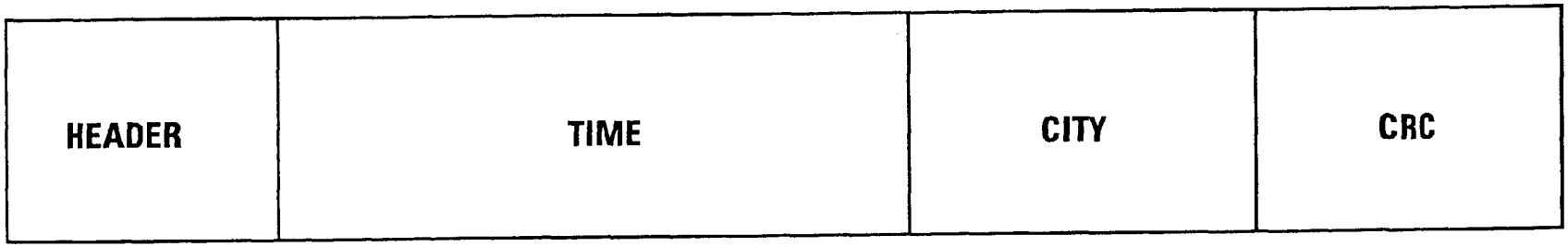
FIG. 7 is an illustration showing an exemplary update transmission protocol for use in updating time and city information on a timepiece.

FIG. 7 is an illustration of an exemplary transmission protocol for use in updating time and city information on a timepiece. Header 700 is utilized to distinguish an update transmission from other transmissions which might be unrelated. When the receiver recognizes a proper header, then the current time 710 and city information 720 is stored along with a cyclical redundancy check information 730. If the CRC information shows no error in the transmission, update of the timepiece can occur with considerable confidence in the accuracy of the information.

Figure 8:
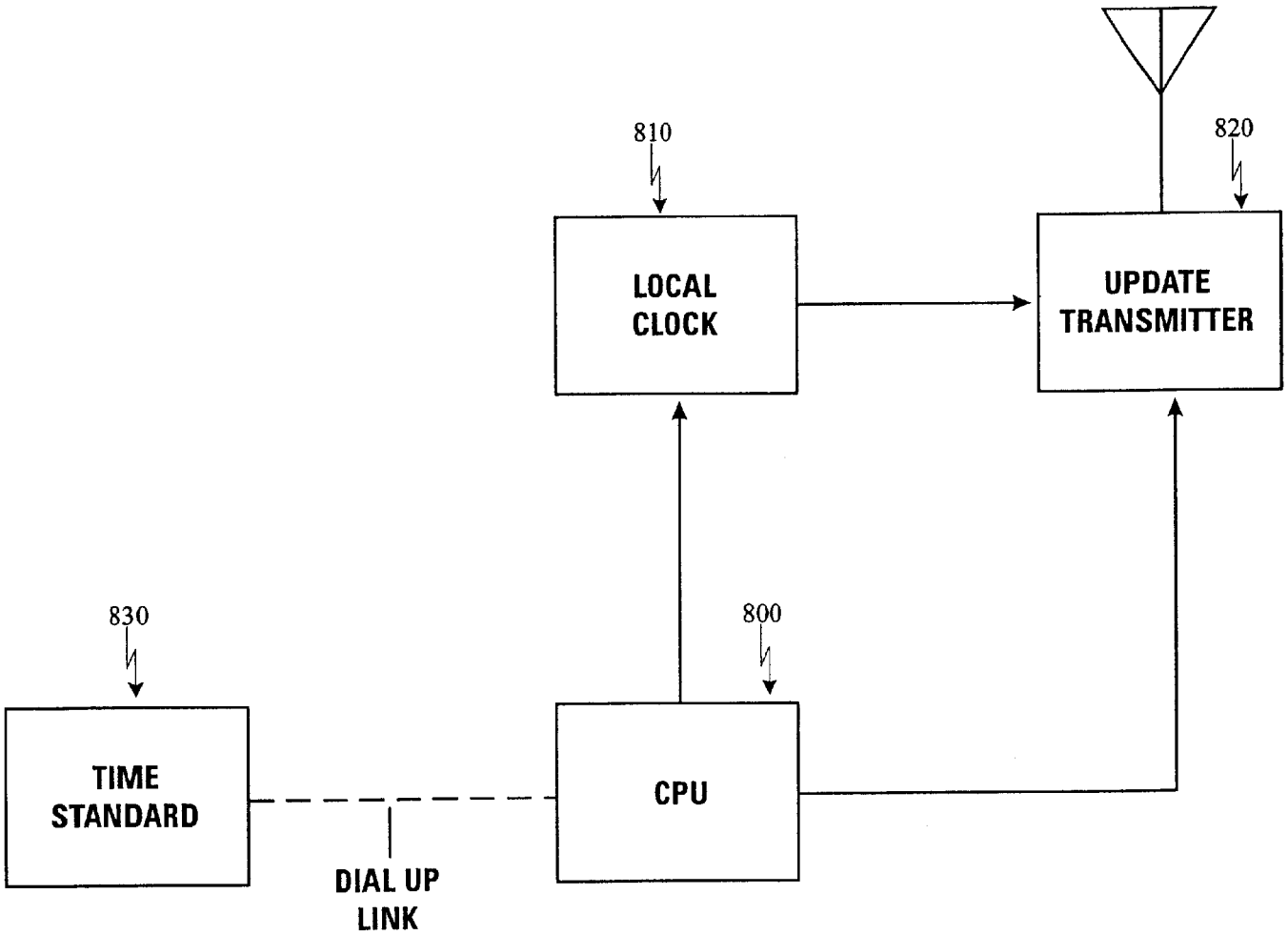
FIG. 8 is a block diagram of an exemplary transmitter for updating timepieces in accordance with one embodiment of the invention.

FIG. 8 is a block diagram of an exemplary transmitter for updating timepieces in accordance with one embodiment of the invention. A CPU 800 exerts certain control over local clock gate 10 and over update transmitter 820. These are discussed more hereinafter. The CPU also selectively connects to time standard 830, preferably over a dial up communications link. When the dial up link is activated, the CPU downloads accurate time standard information and sets the local clock 810 to correspond with the time standard. The city in which the particular update transmitter is located is stored in memory associated with CPU 800 or, alternatively, stored in update transmitter 820. In the example shown, CPU 800 periodically causes the current value of the time set by the local clock 810 and the current value of the city, previously stored, to be transmitted by update transmitter 820 to any remote timepiece within the area of coverage of the transmitter. Typically, the update transmitters will be low powered devices having a very limited range to avoid interference with other communications or with other update transmitters.

Figure 9:
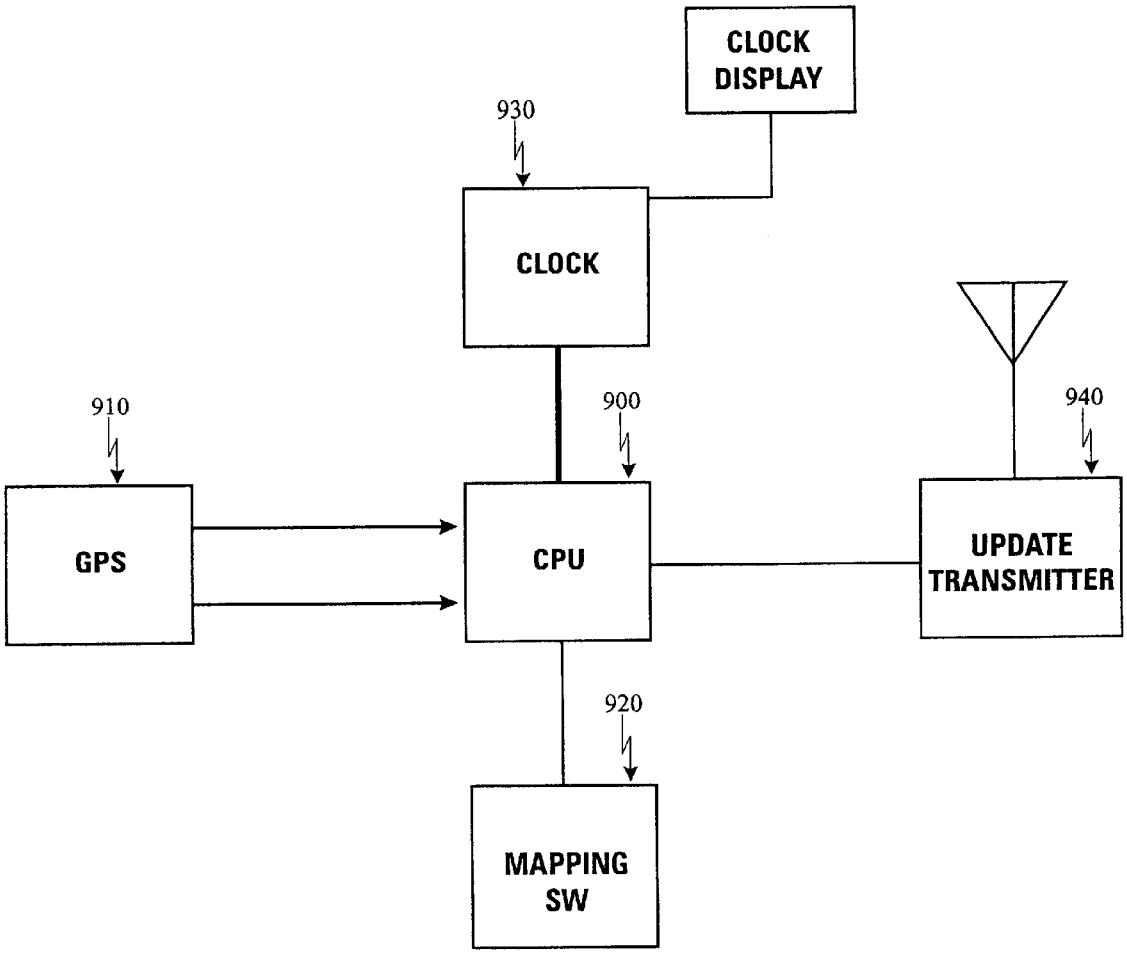
FIG. 9 is a block diagram of a second exemplary transmitter for updating timepieces in accordance with a second embodiment of the invention.

FIG. 9 is a block diagram of a second exemplary transmitter for updating timepieces in accordance with a second embodiment of the invention. The transmitter of FIG. 9 is preferably utilized when the transmitter is to be mounted in a vehicle, such as item 510 of FIG. 5. However, it can also be used as a fixed station transmitter such as shown in items 520 and 530 of FIG. 5. If it is used as a fixed station, then the GPS receiver provides information that is not needed since the location never changes at a fixed location. Nevertheless, it may be desirable to manufacture the timepieces in quantity with the GPS receiver built in.

The numbering of the blocks and their functionality corresponds with that shown in FIG. 2 with the exception that a local clock 930 displaying the time is optional, as shown by the dotted lines, and that, in this embodiment, the GPS receiver is utilized as a time standard for updating the optional clock 930 and for determining the current time as well as the location. The time, thus determined, is provided to update transmitter 940, preferably with city information, for transmission to a remote timepiece for update.

Figure 10:
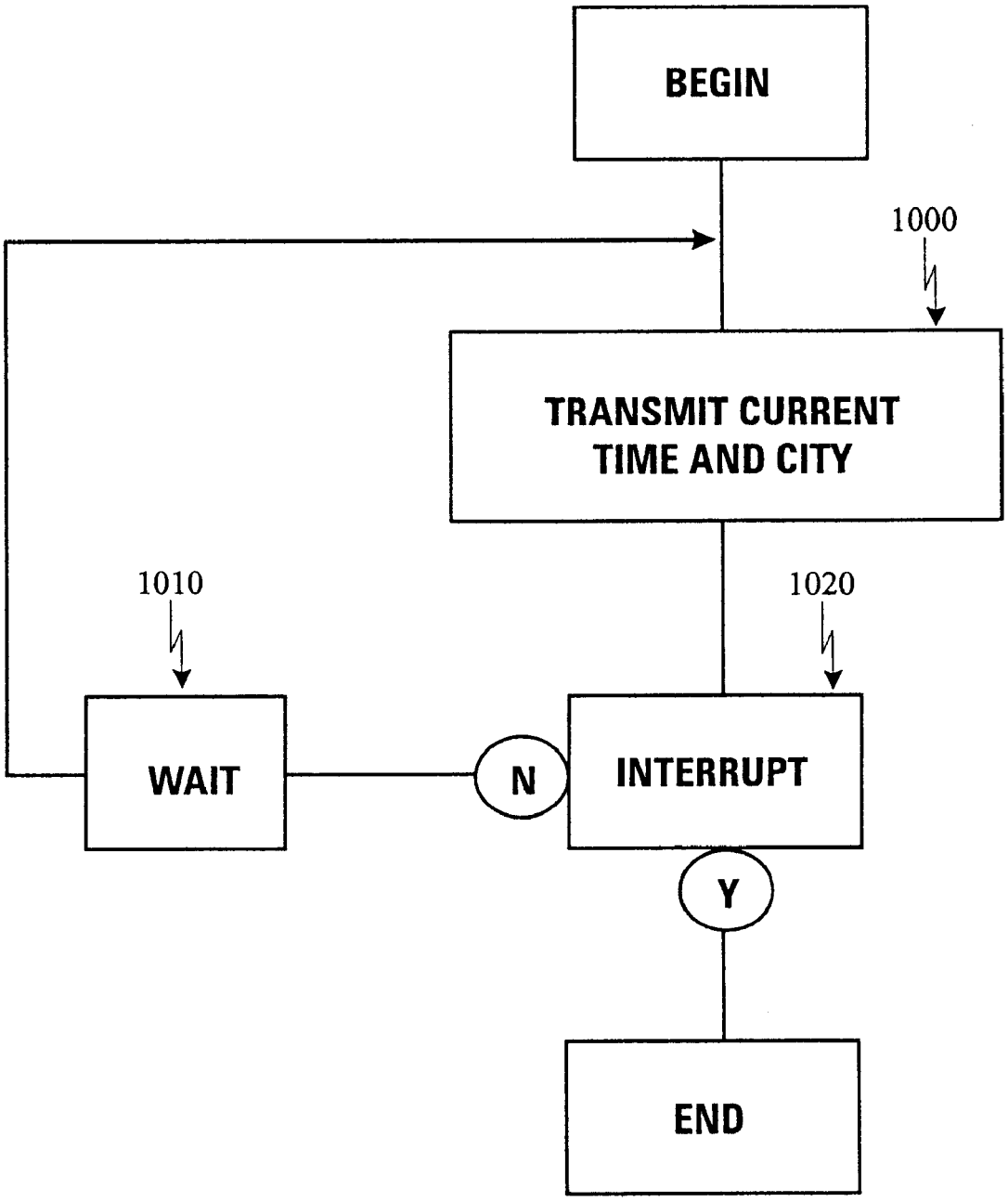
FIG. 10 is a flowchart of a process for controlling the transmission of update information to remote timepieces.

FIG. 10 is a flowchart of a process for controlling the transmission of update information to remote timepieces. The flowchart of FIG. 10 represents a simple control loop in which the current time and city information is transmitted (1000) and if no interrupt is desired (1020) a wait state is entered for a particular duration before transmitting the current time and city information again. If, for some reason it is desired to interrupt the ongoing periodic transmission of time and city information, such as for maintenance, one may selectively interrupt the process (1020-Y) and the process will end.

Figure 11:
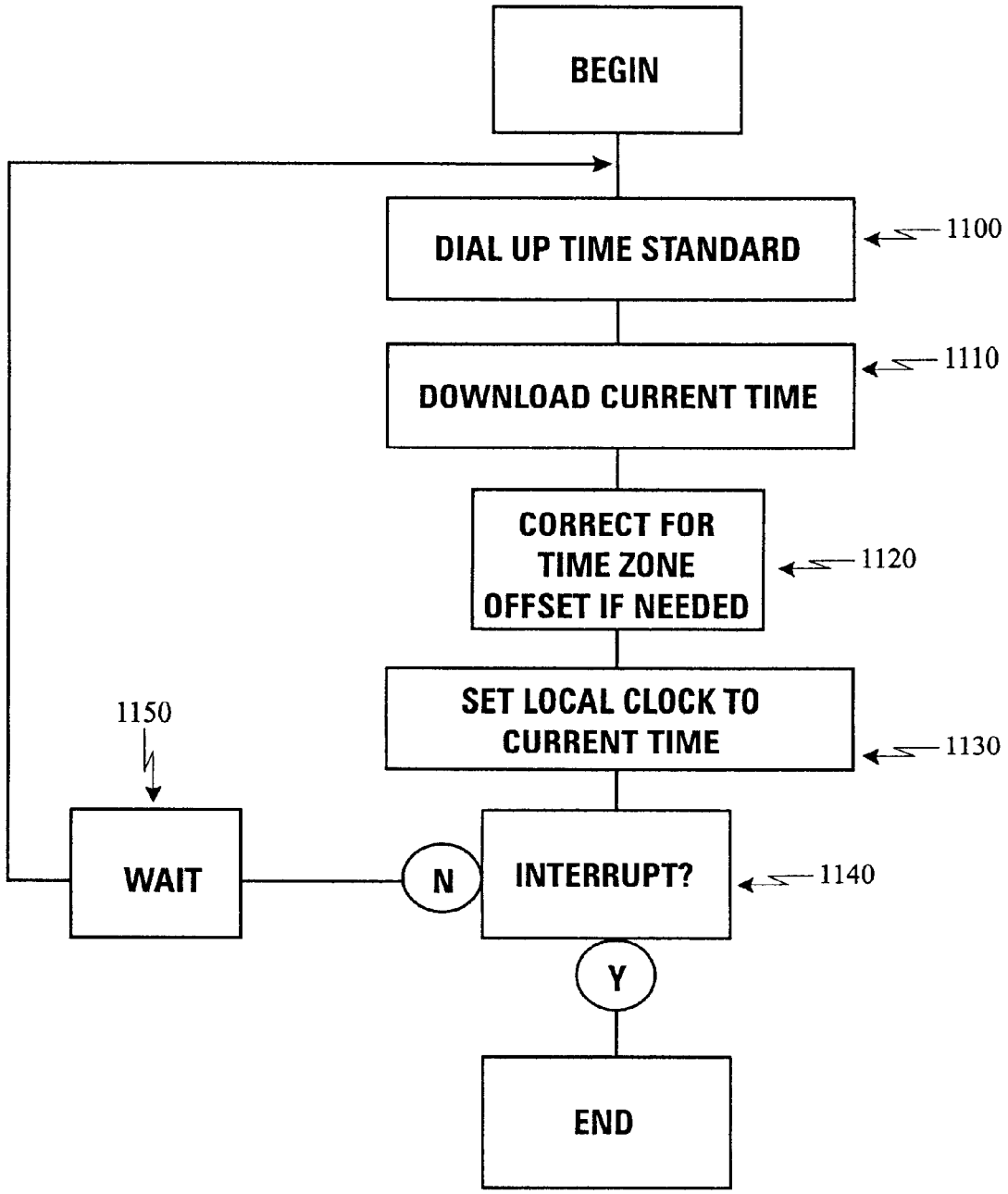
FIG. 11 is a flowchart of a process for calibrating a transmitter used to update remote timepieces.

FIG. 11 is a flow chart of a process for calibrating a transmitter used to update remote timepieces. At step 1100, the CPU dials up a time standard and downloads the current time information (1110). If necessary, the time information is corrected for the time zone offset (1120) and if a local clock exists, it is set to the time determined in Step 1120. If there is no interrupt (1140-N) a wait state 1150 is entered for a particular duration. At the expiration of the wait state, the process repeats. If interrupt is desired (1140-Y), the process ends.

The frequency of update is a function of how accurate the local clock is and what its drift characteristics are. It may be appropriate to update daily or even weekly depending on the stability of the local clock.

Figure 12:
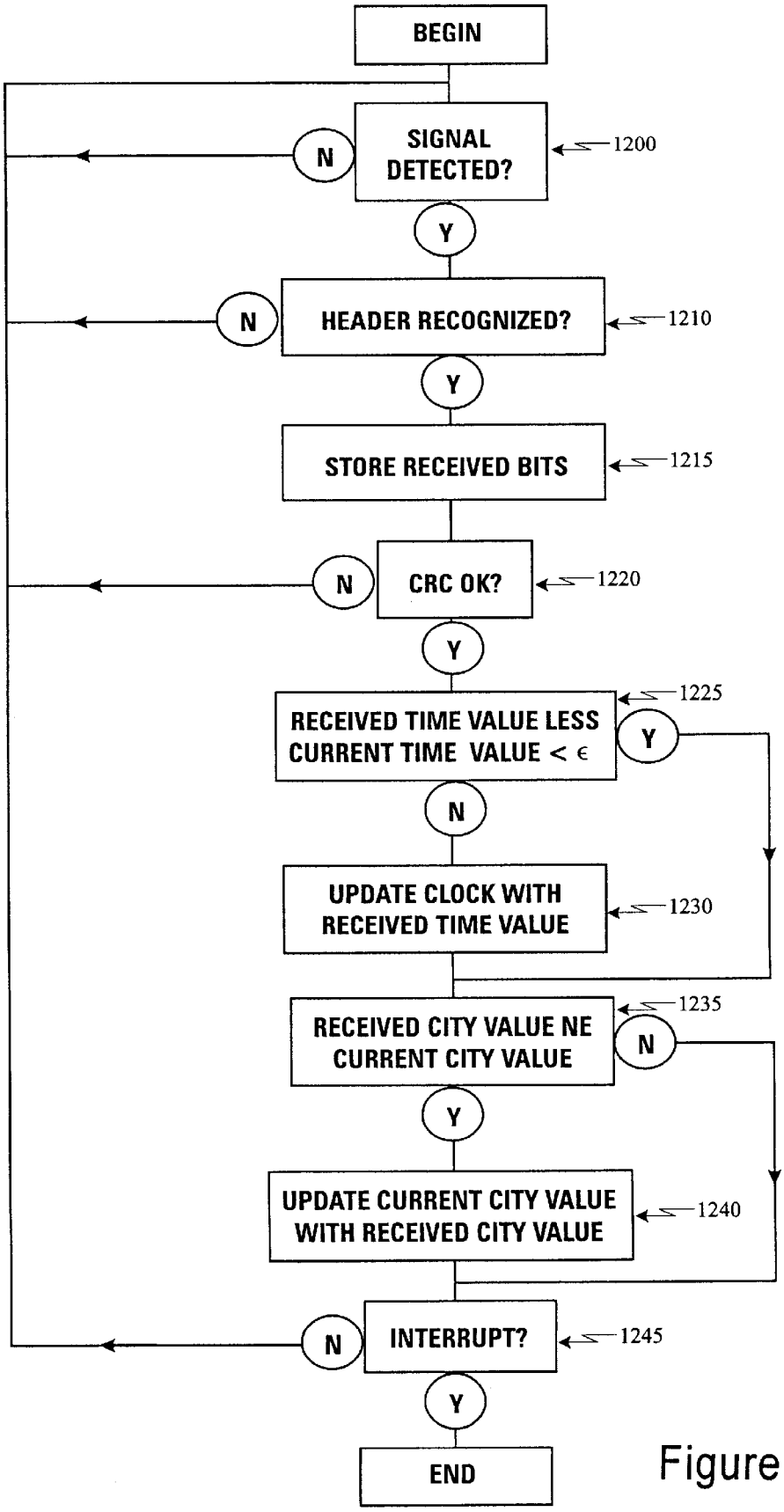
FIG. 12 is a flowchart of a process used to update time and city information at a timepiece not equipped with GPS.

FIG. 12 is a flowchart of a process used to update time and city information at a timepiece not equipped with GPS. A receiver, such as receiver 600 shown in FIG. 6 monitors for incoming electromagnetic signals. If a signal is detected (1200-Y) such as might be indicated by a signal breaking squelch on the receiver, the header information from the transmission is checked (1210) to see if it corresponds to the update header 700 shown in FIG. 7. If it does not, the process loops back to the beginning. If it does, received bits are stored (1215) representing, e.g. time and city information as shown in item 610 of FIG. 6. The optional cyclical redundancy code field 730 is checked to insure that the information was received without corruption. If it was not, the process loops back to the beginning. If it was, a determination is made (1225) whether the absolute value of the received time value differs from the current time value by an amount less than a decision threshold $\epsilon$ if it is not less than $\epsilon$ (1225-N) the clock is updated with the received time value (1230). If it is (1225-Y), the update Step 1230 is bypassed and a comparison is made to determine if the received city value is different from the current city value. If it is not (1235-N), the process loops back to the beginning. If it is (1235-Y) the current city value is updated with the received city value (1240) and the process loops back to the beginning, if there is no interrupt (1245-N). Otherwise, the process ends.

Figure 13:
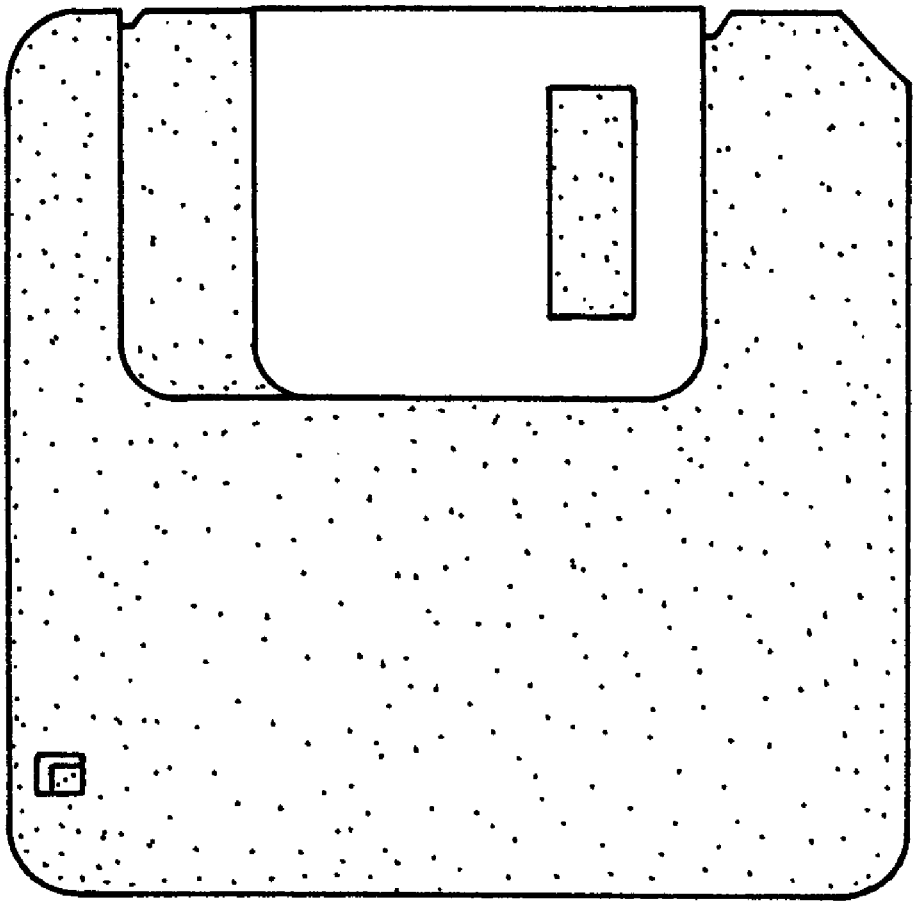
FIG. 13 illustrates an exemplary memory medium containing program information and data usable with computers illustrated throughout the disclosure of the invention.

The processes of FIGS. 10–12 can be implemented as a computer program and stored, typically together with mapping information containing information about time zone boundaries on a memory medium of a computer or on a memory medium for loading onto a computer. FIG. 13 illustrates one such memory medium.

In this disclosure, there is shown and described only the preferred embodiment of the invention, but, as aforementioned, it is to be understood that the invention is capable of use in various other combinations and environments, is capable of changes or modifications within the scope of the inventive concepts as expressed herein.

What is claimed is:

1. A timepiece which automatically changes time as the timepiece crosses a time zone boundary, comprising:

a. a memory medium storing information about time zone boundaries, b. a global positioning satellite system outputting location information, c. a clock, and d. a computer connected to said memory medium, said global positioning satellite system and said clock, configured to change the time of said clock when said location information indicates a time zone boundary has been crossed.

2. The timepiece of claim 1 in which said timepiece includes a transmitter for sending current time information to a remote receiver.

3. A system for updating time information, comprising:

a. an update transmitter including:

a1. a memory medium storing information about time zone boundaries, a2. a global positioning satellite system outputting location information, a3. a system clock, a4. a computer connected to said memory medium, said global positioning satellite system and said system clock, configured to change the time of said system clock when said location information indicates a time zone boundary has been crossed, and a5. a communications transmitter for sending update information to a remote receiver; and b. a timepiece, including b1. a timepiece clock, and b2. a communications receiver configured to receive said update information for updating said timepiece clock.

4. The time piece of claim 3 in which said computer is configured to connect to a time standard and calibrate said system clock with said time standard.

5. The time piece of claim 4 in which said computer connects to a time standard over a network.

6. A method of updating a timepiece to reflect the correct time when a time zone boundary is crossed, comprising the steps of:

a. providing an element for storing time zone boundary information and for using a navigation system to determine location of said timepiece, and b. providing an element for updating said timepiece to reflect the correct time when said navigation system indicates a time zone boundary has been crossed.

7. A computer program product for implementing time correction for a timepiece comprising:

a computer readable memory medium; and a computer program stored on said memory medium, said computer program including instructions for comparing information about a current location of a timepiece with stored information about a time zone boundary, and updating a clock with a time value appropriate for a time zone of said current location.

* * * * *